United States Patent [19]

Enrini

[11] Patent Number: 4,487,518

[45] Date of Patent: Dec. 11, 1984

[54] ADJUSTABLE PRINTER HEAD DRIVE

[75] Inventor: Ferruccio Enrini, Milan, Italy

[73] Assignee: Honeywell Information Systems Italia, Milan, Italy

[21] Appl. No.: 372,908

[22] Filed: Apr. 29, 1982

[30] Foreign Application Priority Data

May 7, 1981 [IT] Italy ..... 21538 A/81

[51] Int. Cl.[3] ..... B41J 25/28

[52] U.S. Cl. ..... 400/320; 400/124; 400/335; 474/49; 474/54

[58] Field of Search ..... 474/49, 54, 56, 47, 474/113; 403/290, 370, 371, 374; 400/320

[56] References Cited

U.S. PATENT DOCUMENTS

| | | | |
|---|---|---|---|
| 211,937 | 2/1879 | Serighelli | 474/54 |
| 389,480 | 9/1888 | Massett | 403/370 X |
| 1,472,565 | 10/1923 | Manning | 403/370 X |
| 3,424,019 | 1/1969 | Wolfram | 474/113 |
| 4,208,141 | 6/1980 | Jagger | 400/320 X |
| 4,304,502 | 12/1981 | Stratienko | 403/370 |
| 4,395,151 | 6/1983 | Krenz | 400/320 |

FOREIGN PATENT DOCUMENTS

| | | | |
|---|---|---|---|
| 55-34941 | 3/1980 | Japan | 400/320 |
| 254047 | 4/1948 | Switzerland | 403/370 |
| 253680 | 6/1926 | United Kingdom | 474/47 |

*Primary Examiner*—Lawrence J. Staab
*Assistant Examiner*—Dwight G. Diehl
*Attorney, Agent, or Firm*—Nicholas Prasinos

[57] ABSTRACT

An adjustable diameter pulley, particularly suitable for the belt tension adjustment in belt transmission system such as those used in serial printers, utilizing a central core having a tapered portion, a threaded cylindrical portion and also a plastic ring having external cylindrical surface and a central tapered opening. The opening receives the conical portion of the core and is provided with deep slits which allow its expansion. A second ring, screwed on the cylindrical portion of the core, causes the expansion of the plastic ring to vary.

1 Claim, 3 Drawing Figures

ADJUSTABLE PRINTER HEAD DRIVE

BACKGROUND OF THE INVENTION

1. Field of the Invention

The present invention relates to an adjustable diameter pulley for use in belt transmission systems and particularly in serial printers.

2. General Description of the Prior Art

It is known that serial printers have a printing carriage on which a printing head is mounted. The carriage slides along two guide bars so as to occupy successive printing positions along a printing line. Examples of such printers are described in U.S. Pat. Nos. 4,044,882, 3,970,183 and 4,229,114. The guide bars are mounted between two sides of the printer frame and movement of the carriage is accomplished by a motor, preferably a step motor, coupled to transmission means, generally and preferably a cog belt. The cog belt is stretched along the guide bars between a driving gear and a driven pulley. The driving gear is splined to the shaft of the motor which, in its turn, is fastened to a side of the printer frame. The driven pulley is fastened to the opposite side of the printer frame by means of a bracket whose position may be adjusted. The precise positioning of the carriage is fundamental in order to obtain a correct printing of the characters. The positioning precision has to be therefore secured by a positive transmission—i.e. a transmission free from slack. For this purpose cog belts are generally used. The cog belts at present on the market are made of rubber, which is stiffened by steel cores. Accordingly the remaining fundamental problem to be solved is the one relating to the slack elimination.

One prior art method for solving this problem is to mount the driven pulley on a bracket which, after having been suitably positioned for the desired slack, is fastened with screws to the printer frame. In order to correctly position the bracket, suitable fixtures are used during the assembling phase; such fixtures allow the bracket to be positioned by exerting a suitable and controlled tension on the belt and then to fasten such bracket. This type of adjustment presents the following disadvantages: once the positioning fixtures are removed, a certain constraint yielding may occur and further, such yielding may increase during the printer operation; therefore the slack elimination does not correspond exactly to the desired values.

Another type of adjustment uses a movable bracket on which a spring exerts a suitable force opposing the force exerted by the belt on the pulley. Such type of adjustment eliminates slack, but it introduces into the transmission system an elastic constraint which modifies the tension state of the belt under variable dynamic condition. In fact, during the acceleration phases of the printing carriage in the direction of the driven pulley, the motor torque and the carriage inertia involve an increase of tension exerted by the belt on the elastic constraint; in contrast, during the acceleration phases of the printing carriage in the opposite direction, there is a reduction of tension. Therefore the above adjustment has the disadvantage of introducing a displacement between the real position and the ideal position of the printing carriage. Such ideal position of the printing carriage corresponds to a predetermined angular position of the driving gear. In addition to the above disadvantages oscillations may appear during the carriage movement. In order to reduce these disadvantages, it is necessary to exert a considerable stretching action. However, in such case, the belt tends to yield and wear, due to the considerable tension to which it is subjected and the position becomes less precise with time.

The present invention avoids all these disadvantages and permits the accurate adjustment of the belt tension and for eliminating slack, without requiring the use of special fixtures and without introducing elastic constraint and construction complications. Moreover, the present invention has the further advantage of permitting easy adjustment of the belt tension during field maintenance operations.

OBJECTS OF THE INVENTION

It is therefore an object of the invention to provide an improved power transmission system.

It is another object of the invention to provide an improved pulley for use in transmitting power via a belt and pulley system.

These and other objects of the invention will become apparent upon the reading of the specification in conjunction with the drawings.

SUMMARY OF THE INVENTION

According to the invention, the above objects and advantages are realized by using an adjustable diameter driven pulley having a plastic ring assembly which expands and contracts elastically within predetermined limits. A core assembly has a tapered portion provided with a longitudinal central opening, and includes a cylindrical threaded portion. The core assembly is inserted in the longitudinal central opening of the ring assembly. A nut or a knurled ring with a central threaded seat is screwed on the threaded portion of the core and engages the plastic ring which is on the tapered core, thus moving it longitudinally on the taper. In such a way it is possible to obtain lateral expansion of the external plastic ring; i.e., an adjustable variation of the plastic ring diameter.

BRIEF DESCRIPTION OF THE DRAWINGS

These advantages and the features of the invention will appear more clearly from the following description of a preferred embodiment of the invention and from the enclosed drawings where.

DESCRIPTION OF THE PREFERRED EMBODIMENT OF THE INVENTION

Figure 1:
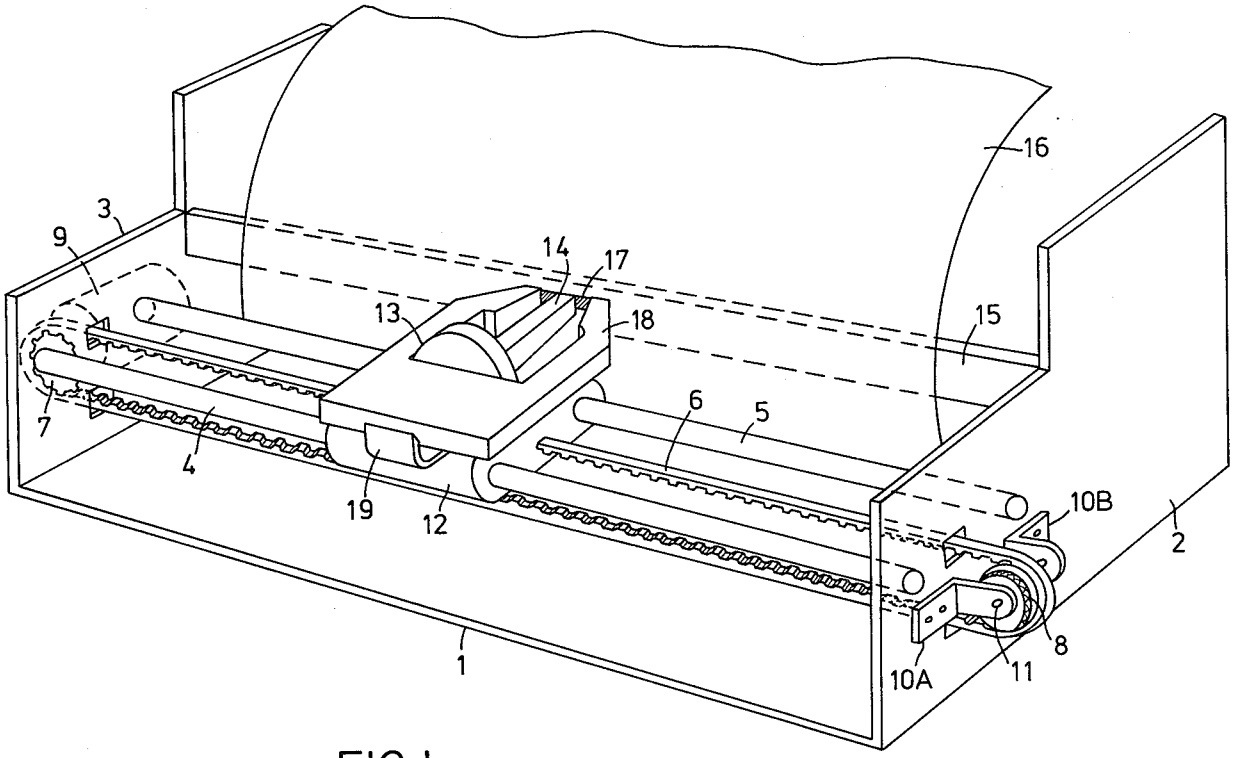
FIG. 1 shows the mechanical structure of a serial printer illustrating the invention.

Referring to FIG. 1, the mechanical structure of a serial printer comprises a frame having a base 1 and two side plates 2, 3. Both base 1 and side plates 2, 3 are of metal sheet having a suitable thickness in order to provide a sturdiness to the printer. (Alternatively casting structures may be used.) Two parallel guide bars 4, 5, are fastened between side plates 2, 3.

A printing carriage 12 is slidably mounted on guide bars 4, 5 by means of axial slide bushings or bearings. A belt 6, fixed to carriage 12, extends parallel to guide bars 4, 5 and winds around a driving gear 7 on one side and around a driven pulley 8 on the other side. The driven pulley is hinged on a pin 11 firmly fastened to side 2 through suitable rigid brackets 10A, 10B. Gear 7 is splined to the shaft of a motor 9 fixed to side 3. Motor 9, preferably a step motor, causes, through belt 6, the motion of carriage 12 along guiding bars 4, 5. A printing head 13 is mounted on carriage 12. The printing head is provided with a printing nose 14 which, owing to the carriage motion, slides along the printing line next to a platen 15. Platen 15 is comprised of a bar firmly fixed to side plates 2, 3 and parallel to guide bars 4, 5. Printing head 13 is of the needle type—i.e., the printing needles (not visible in FIG. 1) are activated to protrude from nose 14 and press an inked ribbon 17 against a printing support 16 leaning on platen 15. Inked ribbon 17 is contained in a cartridge 18, typically of the type described in British Pat. No. 1,502,760. Such cartridge is mounted on printing carriage 12 and held thereon by elastic brackets, such as bracket 19. The inked ribbon movement is caused by feeding means not shown in FIG. 1; such means are well known in the art and therefore are beyond the scope of the invention. Printing support 16 runs transverse to the printing line by means of feeding devices well known in the art and accordingly not shown in FIG. 1 because they are beyond the scope of the invention. In accordance to the invention the tension of belt 6 is suitably adjusted by varying, in a simple way, the diameter of driven pulley 8.

Figure 2:
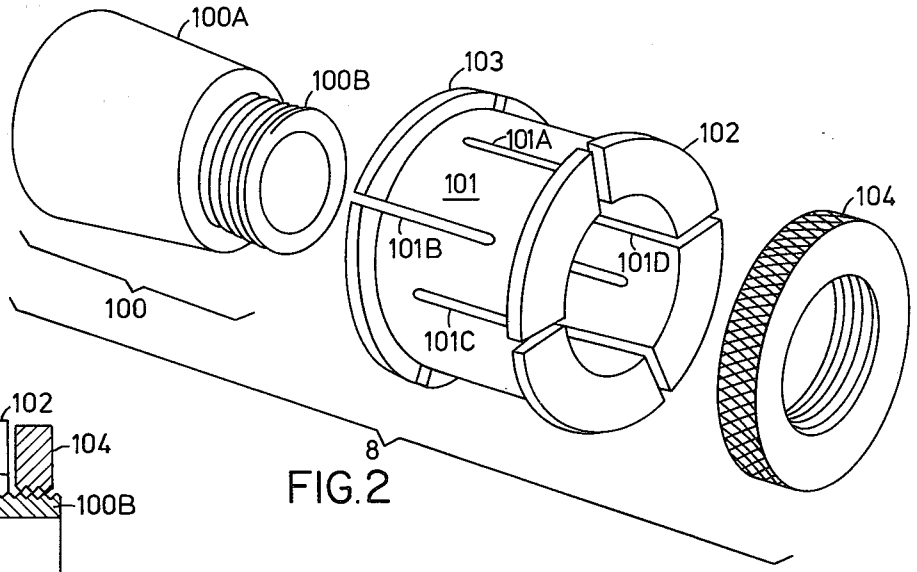
FIG. 2 shows an exploded perspective view of the elements forming the invention.
Figure 3:
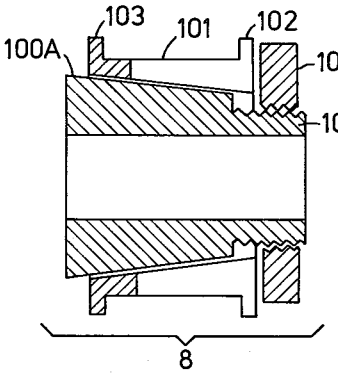
FIG. 3 is a cross sectional view of the invention.

This may be better understood by referring to FIGS. 2 and 3. Referring to FIG. 2, pulley 8 comprises a core 100 pivotally mounted on pin 11 of FIG. 1 for rotation thereon. Coupling between core 100 and pin 11 is accomplished by the interposition of either an antifriction bushing or bearing. Core 100 comprises a tapered portion 100A and a threaded cyclindrical portion 100B protruding beyond the tapered portion summit. The core is inserted in the central opening of a plastic ring 101 provided with an external cylindrical surface around which the belt is wound and with two side shoulders 102, 103 for belt confinement and guidance.

The central opening of ring 101 is tapered too; in particular the inner surface of ring 101 is in contact with the surface 100A when core 100 is inserted into ring 101 (FIG. 3). Since ring 101 has a plurality of longitudinal slits 101A, 101B, 101C, 101D . . . which alternately extend from one or the other side face in the body of the ring having a length shorter than the axial length of ring 101. It is clear that by inserting or retracting core 100 into the central opening of ring 101, ring 101 expands or contracts because the slits expand or contract under pressure of the tapered surface; thus the result is an increase or decrease of the diameter of the external cylindrical surface of ring 101. The insertion depth of core 100 into ring 101 is determined by a knurled ring 104 havng a central threaded seat which is screwed on threaded cylindrical portion 100B protruding through ring 101. Core 100 of driven pulley 8 may rotate on pin 11 of FIG. 1, but its axial movement is directly prevented by brackets 10A, 10B, or preferably by axial positioning washers inserted on the pin and interposed between the brackets and the core. It should be noted that, when knurled ring 104 is screwed on threaded portion 100B, an axial relative displacement between the ring 101 and core 100 occurs; for such purpose the width of ring 101, that is the distance between side shoulders 102 and 103, is suitably somewhat larger than the one of belt 6 so as to allow some transverse clearance of such belt.

Several modifications may be made to the described adjustable diameter pulley without departing from the spirit and scope of the present invention.

What is claimed is:

1. In combination with a serial printer an adjustable diameter pulley for adjusting belt tension in a belt transmission system which moves a printing head along a printing line comprising:

a plastic cylinder having a tapered longitudinal internal surface, a cylindrical external surface acting as a winding surface for a belt and two flat sides perpendicular to said cylindrical surface, said cylinder further having a plurality of longitudinal slits partially extending alternately from either longitudinal end of said cylinder:

a core provided with a tapered portion inserted in said cylinder, said core further having a threaded portion extending longitudinally;

positioning means for positioning said plastic cylinder on said core, said positioning means comprising an annular ring having its internal surface threaded, said annular ring engaging said threaded portion of said core and being capable of longitudinal motion when screwed on said threaded portion; whereby said positioning means contacts one end of said cylinder urging said cylinder in a longitudinal direction, thus radially expanding the cylindrical external surface of said plastic cylinder whereby the belt tension in the belt transmission system which moves a printing head along the printing line is appropriately adjusted.

* * * * *